US005618482A

United States Patent [19]

Olesen et al.

[11] Patent Number: 5,618,482

[45] Date of Patent: Apr. 8, 1997

[54] METHOD OF PRODUCING FIBREBOARD

[75] Inventors: Tine Olesen, Veksø; Lars S. Pedersen, Farum; Lars H. D. Andersen, Lyngby, all of Denmark

[73] Assignee: Novo Nordisk A/S, Bagsvaerd, Denmark

[21] Appl. No.: 446,801

[22] PCT Filed: Oct. 12, 1994

[86] PCT No.: PCT/DK94/00378

§ 371 Date: Oct. 20, 1995

§ 102(e) Date: Oct. 20, 1995

[87] PCT Pub. No.: WO95/07604

PCT Pub. Date: Mar. 23, 1995

[51] Int. Cl.[6] ..... B27N 3/00

[52] U.S. Cl. ..... 264/109; 264/122

[58] Field of Search ..... 264/109, 122; 435/171, 192, 156

[56] References Cited

U.S. PATENT DOCUMENTS

| | | | |
|---|---|---|---|
| 2,037,522 | 4/1936 | Lundbäck | 264/109 |
| 4,194,997 | 3/1980 | Edler | 264/109 |
| 4,432,921 | 2/1984 | Haars et al. | 264/109 |
| 5,342,765 | 8/1994 | Irvine et al. | 435/71.1 |

OTHER PUBLICATIONS

SU 636,311, Sukhaya et al, Soviet Patent application, published May 12, 1978 Bulletin No. 45.

DD 271 078 A1, Wagenfuhr et al., Industrial Patent granted Aug. 23, 1989.

*Primary Examiner*—David A. Simmons
*Assistant Examiner*—Kenneth M. Jones
*Attorney, Agent, or Firm*—Steve T. Zelson, Esq.; Valeta Gregg, Esq.

[57] ABSTRACT

A method of producing a fiberboard having improved mechanical properties such as water uptake (swelling), tensile strength perpendicular to the surface (IB), modulus of elasticity (MOE), and modulus of rupture (MOR) of the resulting fiberboard. The method includes providing a slurry of lignin-containing wood fiber material, adding a phenol oxidizing enzyme system, forming a mat of the wood fiber material, and pressing the formed mat by applying heat and pressure.

16 Claims, 1 Drawing Sheet

METHOD OF PRODUCING FIBREBOARD

This application is a 371 of PCT/DK94/00378, Oct. 12, 1994.

TECHNICAL FIELD

The present invention relates to an improved method of producing fibreboard by a wet process, more specifically to a method comprising the steps of providing an aqueous slurry of lignin-containing wood fibre material, forming the aqueous fibre slurry into a mat, and pressing the formed mat by applying heat and pressure to produce the fibreboard. By the method of the invention is prepared fibreboard having improved mechanical properties.

BACKGROUND ART

Fibreboard is conventionally produced by defibration or steam explosion of wood chips to obtain wood fibres, forming a mat of the fibres, and pressing the mat while applying heat and pressure. Conventionally, the mat is prepared either by a dry process from wood fibres with a water content below 120% (by weight of the dry fibres) with addition of adhesives, or by a wet process from an aqueous slurry of wood fibres with a water content of 200–10000% (by weight of the dry fibres).

In the wet process, it is conventional to add a binder (adhesive) to the aqueous fibre slurry and/or to cure the fibreboard at high temperature after the pressing, in order to improve the mechanical properties of the fibreboard.

SU 636,311 and DD 271,078 disclose processes wherein microorganisms productive of enzymes such as laccase are cultivated on wood chips before defibration to make wood fibres for use in fibreboard.

It is the object of this invention to provide an improved wet process for producing fibreboard of improved mechanical properties without the need for the addition of binder or the final curing.

STATEMENT OF THE INVENTION

Surprisingly, we have found that fibreboard of improved mechanical properties can be produced by adding a phenol oxidizing enzyme system to the slurry in a wet process. Apart from the addition of the enzyme system, the process can be conducted at conventional conditions, without the need for any changes of equipment. The addition of the enzyme system results in improved mechanical properties of the fibreboard, such as decreased swelling, increased resistance to bending and increased transversal strength, without the need for the addition of a binder or a final curing step.

Accordingly, the invention provides a method of producing fibreboard, comprising the sequential steps of:

(a) providing an aqueous slurry of lignin-containing wood fibre material, (b) adding a phenol oxidizing enzyme system to the fibre slurry, (c) forming the fibre slurry into a mat of the wood fibre material, and (d) pressing the formed mat by applying heat and pressure to produce the fibreboard, wherein the enzyme system is added in an effective amount for a achieving improved mechanical properties of the fibreboard produced.

In the process of this invention, the enzyme system may act on lignin present on the fibres during the hot pressing and/or during an optional incubation step between steps (b) and (c).

DETAILED DESCRIPTION OF THE INVENTION

Wood fibre slurry

Figure 1:
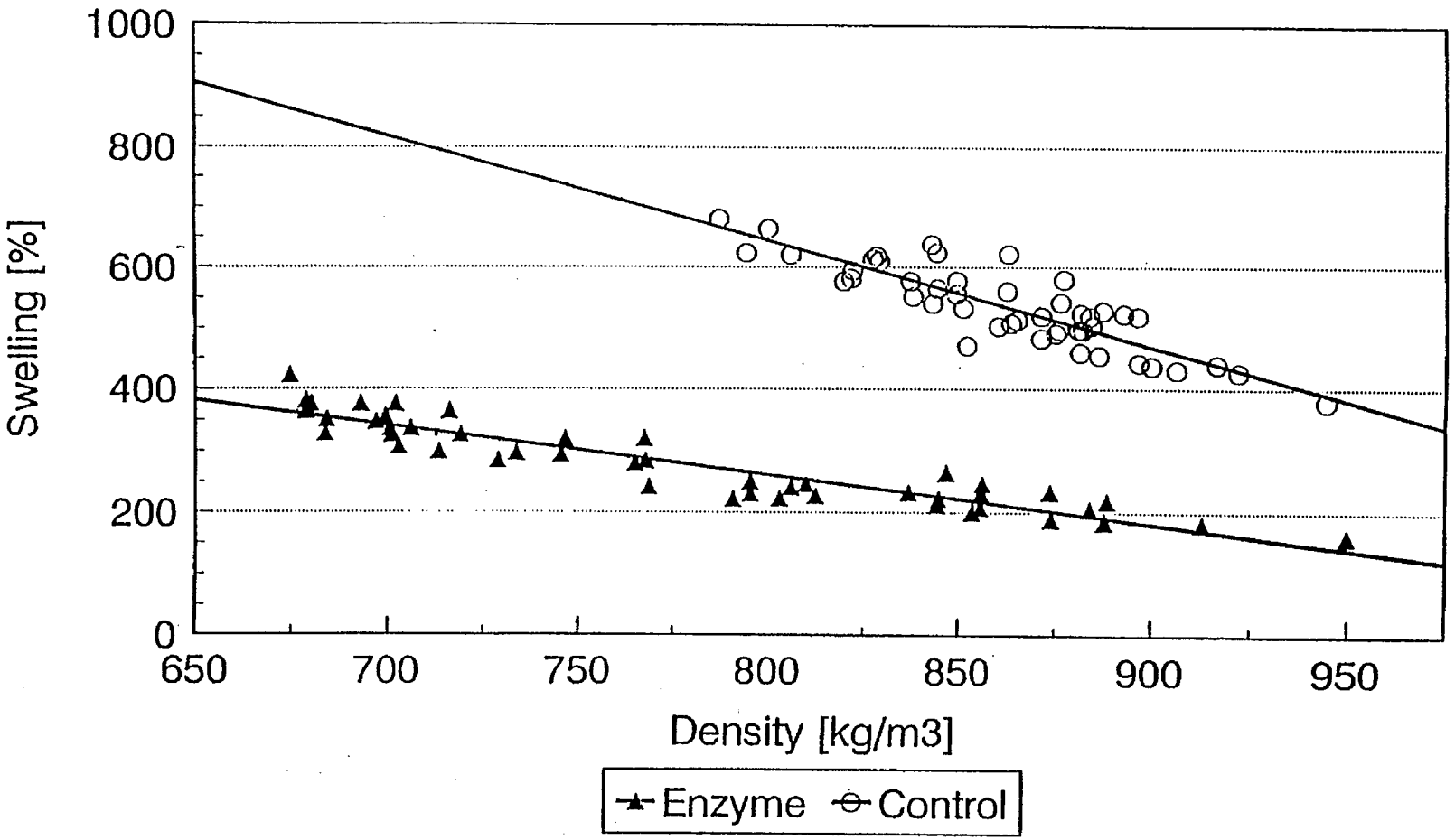
FIG. 1 showing swelling relative to board density. Swelling is measured as percent water uptake of the conditioned weight of the fibre board; ○: board formed from fibres treated with inactive laccase; ▲: board formed from fibres treated with active laccase.

The wood fibres used in the process of this invention may be any type of lignin-containing fibres suitable for use in a conventional wet fibreboard process, e.g. softwood or hardwood produced by a mechanical or semi-chemical defibration or pulping process, i.e. grinding, TMP (thermomechanical pulping), CTMP (chemical thermomechanical pulping), NSSC (neutral sulphite semichemical); or recycled fibres. Thus, the wood fibres may be made by conventional defibration or steam explosion of wood chips for fibre board production.

The water content of the wood fibre slurry is preferably from about 200% to about 10000% (based on the weight of dry wood fibre material), more preferably from about 500% to about 5000%.

pH of the slurry is preferably from about 3 to about 10, depending on the enzyme used; pH from about 3 to about 7.5 is suitable for laccase, and pH from about 6 to about 10 is suitable for peroxidase.

Phenol oxidizing enzyme system

The enzyme system used in the method of the present invention consists of a suitable oxidase together with $O_2$ or a suitable peroxidase together with $H_2O_2$. Suitable enzymes are those which oxidize and polymerize aromatic compounds such as phenols and lignin.

Examples of suitable enzymes are catechol oxidase (EC 1.10.3.1), laccase (EC 1.10.3.2), bilirubin oxidase (EC 1.3.3.5) and peroxidase (EC 1.11.1.7). Examples of preferred enzymes are peroxidase derived from Coprinus, e.g. the strains *C. cinerius* or *C. macrorhizus*, peroxidase from Bacillus, e.g. the strain *B. pumilus*, and laccase from Trametes, e.g. *T. villosa* (previously called Polyporus). It may be preferable to use two different phenol oxidizing enzymes together.

A useful amount of peroxidase to be used in the process of the present invention is from about 0.02 to about 2000 PODU per g of fibre material (the PODU unit of peroxidase activity is defined below). The amount of laccase to be used in the process of the invention is preferably from about 0.02 to about 2000 LACU per g of fibre material, more preferably from about 100 to about 1000 LACU per g (the LACU unit of laccase activity is defined below).

When using an oxidase, molecular oxygen must be from the atmosphere may be present in sufficient quantity, or the fibre slurry may be aerated during the incubation. When using a peroxidase, a suitable amount of $H_2O_2$ will usually be between about 0.01 mM and about 10 mM, particularly between about 1 mM and about 10 mM.

Determination of peroxidase activity (PODU)

1 peroxidase unit (PODU) is the amount of enzyme that catalyses the conversion of 1 μmol hydrogen peroxide per minute at the following analytical conditions: 0.88 mM hydrogen peroxide, 1.67 mM 2,2'-azinobis(3-ethylbenzothiazoline-6-sulfonate), 0.1M phosphate buffer, pH 7.0, incubated at 30° C., photometrically followed at 418 nm.

Determination of oxidase activity (LACU)

This method is based on the oxidation of syringaldazin to tetramethoxy azo bis-methylene quinone under aerobic conditions. 1 LACU is the amount of enzyme which converts 1 μM syringaldazin per minute at the following conditions: 19 μM syringaldazin, 23.2 mM acetate buffer, 36 μM $Cu^{++}$, 30° C., pH 5.5, reaction time 1 minute, shaking. The reaction is followed spectrophotometrically at 530 nm.

Optional incubation

Optionally, the fibre slurry may be incubated after the enzyme addition, i.e. prior to the mat formation. The incubation may be carried out at a temperature between about 20° C. and about 80° C. Preferably, the incubation is carried out for at least 15 minutes, more preferably for between 15 minutes and 10 hours, especially for between 15 minutes and 2 hours.

Mat formation

The method of the invention comprises the step of forming a wood fibre mat from the slurry. This process step may be carried out in a conventional manner, generally by removing water while retaining the fibres on a suitable screen.

Optionally, the formed mat may be dried in a conventional manner. In case of producing S2S ("smooth two sides") boards, the water content in the resulting boards are typically below 20%.

Pressing

The pressing of the mat while applying heat and pressure may be carried out in a conventional manner, e.g. at a temperature of between 150° C. and 250° C. for from about 2 to about 20 minutes at a pressure of between about 20 bar to about 100 bar.

The following non-limiting examples illustrate the invention.

EXAMPLE 1

Raw material:

Beech wood fibres produced by a NSSC (Neutral Sulphite Semi-Chemical) process and originating from a MDF (Medium Density Fibreboard) factory.

Active Enzyme:

Laccase derived from *Trametes villosa* (former named *Polyporus pinsitus*), available from Novo Nordisk A/S, Bagsvaerd, Denmark.

Inactive Enzyme:

Thermally inactivated laccase (derived from the active enzyme described above).

The experiment:

12 samples of wood fibres were suspended in deionized water at a water content of 5400%. (1.85% dry matter).

6 samples ("enzyme treated") were treated with active enzyme and 6 samples ("control") with inactive enzyme for 1 hour at room temperature. The enzyme treated fibres were treated with an enzyme dosage corresponding to 5 LACU/g of fibre dry matter. The control samples were treated with an equivalent amount of inactive enzyme.

The samples were stirred with an impeller type mixer during the enzyme treatment. Prior to addition of enzyme pH was adjusted to 6.5 using sulphuric acid.

After this initial enzyme treatment each of the 12 wood fibre samples were formed into a fibre mat using a PFI-sheet former or mould (normally used for preparing hand sheets for paper testing).

The wet mats were pressed for 3 minutes at room temperature and at a pressure of 7.5 bar. After this pressing the water content of the mats was about 100% (50% dry matter).

The mats were dried at 50° C., conditioned at 65% RH, 23° C., and pressed into fibre boards in a hot press. The hot pressing was carried out for 4 minutes at 160° C. using a pressure aiming at a final board thickness of 3 mm.

Test of mechanical properties (swelling test)

From each board 8 pieces (50×50 mm) were cut and then conditioned at 65% RH, 23° C.

All test pieces were placed horizontally in deionized water at room temperature for 2 hours. The swelling was determined gravimetrically.

The swelling is measured in terms of percent water uptake of the conditioned weight of the fibre board.

FIG. 1 shows the swelling versus the board density. The figure demonstrates clearly that the swelling of the enzyme treated board is significantly lower than the swelling of the control (treated with inactive enzyme). Since low swelling is a very important property for a fibre board, it is thus demonstrated that fibreboard produced according to the method of the present invention has improved mechanical properties.

EXAMPLE 2

Raw material: Beech wood fibres (see example 1).

Active enzyme: Laccase (see example 1).

The Experiment:

12 samples of wood fibres were suspended in deionized water at a water content of 4900% (2% dry matter).

The samples were treated for 1 hour at room temperature: 6 samples ("enzyme treated") with enzyme and 6 samples ("control") without addition of enzyme. The enzyme treated fibres were treated with an enzyme dosage corresponding to 3 LACU/g of fibre dry matter. The samples were stirred with an impeller type mixer during the enzyme treatment. Prior to addition of enzyme pH was adjusted to 6.5 using sulphuric acid.

Then, each sample was formed into a fibre mat using a conventional sheet mould (normally used for preparing handsheets for paper testing). The wet mats were pressed for 3 minutes at room temperature and at a pressure of 7.5 bar. After this pressing the water content of the mats were about 100% (50% dry matter).

The wet mats were then placed on a metal net and pressed in a hot press to form a S-1-S ("smooth one side") hardboard. The boards were pressed for 5 minutes at 180° C. using a pressure aiming at a final board thickness of 3 mm. The pressure was lifted for a few seconds after 1 minute of pressing to allow vapour to escape.

The resulting boards were tested for water uptake (swelling test), tensile strength perpendicular to the surface (IB), modulus of elasticity (MOE) and modulus of rupture (MOR).

Water uptake:

Test pieces each having a size of 50 mm×50 mm was cut and conditioned at 65% RH, 23° C. The test pieces were then placed horizontally complete immersed in deionized water at room temperature for 2 hours. Water uptake was determined gravimetrically as percent weight gain by the water uptake, relative to the conditioned weight of the boards.

Tensile strength perpendicular to the surface (IB):

IB was determined according to the European standard EN319:1993, Particleboards and fibreboards—Determination of tensile strength perpendicular to the plan of the board.

Modulus of elasticity (MOE) and modulus of rupture (MOR): MOE and MOR was determined according to the European standard EN310:1993, Wood-based panels—Determination of modulus of elasticity in bending and of bending strength.

The results are shown in the following table.

TABLE

| | Control | Enzyme Treated | Percent improvement |
|---|---|---|---|
| Water Uptake [%] | 96 | 82 | 15 |
| IB [MPa] | 1, 0 | 1, 6 | 51 |
| MOR [MPa] | 40 | 45 | 11 |
| MOE [GPa] | 3, 2 | 3, 4 | 4 |

All the boards had almost the same density: 1053 $kg/m^3 \pm 3.4$ $kg/m^3$ (95% conf. limit). Accordingly, the variation in density has been disregarded and all test results listed in the table are simple average values.

The results clearly demonstrate that all the tested mechanical properties tested are improved in fibreboards produced according to the method of the invention.

EXAMPLE 3

For some applications it is desirable to improve the strength of hardboard by addition of water soluble resins to the fiber suspension before board formation and pressing. However, the method of the invention, i.e. the enzyme treatment, may be used as substitute for such addition of resin, since a similar effect (improved strength) can be obtained by treating the fiber suspension enzymatically.

This is illustrated by the following experiment.

Samples of wood fibres were suspended in deionized water at a water content of 4900% (2% dry matter). 1% of fibre dry weight of phenolic resin (phenol formaldehyde) was added to the fibres. A mat was formed and the water was removed by cold pressing. Finally, a board was formed by hot pressing as described in example 2.

The mechanical properties, i.e. IB, MOE and MOR, of the resulting boards were found to be similar to the properties of the enzyme treated boards produced as described in example 2.

We claim:

1. A method of producing fibreboard, comprising the sequential steps of:

(a) providing an aqueous slurry or suspension of lignin-containing wood material, (b) adding a phenol oxidizing enzyme system to the slurry, (c) forming the slurry into a mat, and (d) pressing the formed mat by applying heat and pressure to produce the fibreboard, wherein the enzyme system is added in an effective amount for achieving improved mechanical properties of the fibreboard produced, with the proviso that the method does not include addition of binder to the slurry or fibreboard.

2. The method of claim 1 wherein the slurry contains water in an amount of between about 200% and about 10,000% by weight of the lignin-containing wood material.

3. The method of claim 2 wherein the slurry contains water in an amount of between about 500% and about 5,000%, by weight of the lignin-containing wood material.

4. The method of claim 1 wherein the phenol oxidizing enzyme system consists of a peroxidase and hydrogen peroxide.

5. The method of claim 4, wherein the peroxidase is derived from Coprinus or Bacillus.

6. The method of claim 5, wherein the peroxidase is derived from *Bacillus pumilus*.

7. The method of claim 4 wherein the peroxidase is added in an amount of between about 0.02 and about 2,000 PODU per g of lignin-containing wood material, and the hydrogen peroxide is added in a concentration of between about 0.01 mM and about 10 mM.

8. The method of claim 1 wherein the phenol oxidizing enzyme system consists of oxygen and an enzyme selected from the group consisting of laccase, catechol oxidase and bilirubin oxidase.

9. The method of claim 8 wherein the slurry is aerated during the incubation.

10. The method of claim 8 wherein the enzyme is laccase derived from Trametes.

11. The method of claim 8 wherein the enzyme is added in an amount of between 0.02 and about 2000 LACU per g of lignin-containing wood material.

12. The method of claim 1 wherein the method further comprises incubation of the slurry, after the addition of the enzyme, for at least 15 minutes.

13. The method of claim 12, wherein said incubation is for about 15 minutes to about 10 hours.

14. The method of claim 13, wherein said incubation is for about 15 minutes to about 2 hours.

15. The method of claim 12 which further comprises drying the formed mat before pressing.

16. The method of claim 15 wherein the drying is continued to a water content below about 20% by weight of the lignin-containing wood material.

* * * * *